United States Patent [19]

Fromion et al.

[11] Patent Number: 5,040,722

[45] Date of Patent: Aug. 20, 1991

[54] PACKING BOX WITH SELF-LOCKABLE CLOSURE AND PACKING METHOD THEREFOR

[75] Inventors: Andre Fromion, L'Hay les Roses; Jean-Claude V. Boas, Sannois, both of France

[73] Assignee: Bull S. A., Paris, France

[21] Appl. No.: 522,511

[22] Filed: May 11, 1990

[30] Foreign Application Priority Data

May 12, 1989 [FR] France ..... 89 06293
Dec. 18, 1989 [FR] France ..... 89 16688

[51] Int. Cl.[5] ..... B65D 5/46

[52] U.S. Cl. ..... 229/117.17; 229/125.26; 229/148

[58] Field of Search ..... 229/117.16, 117.17, 229/125.26, 145, 148, 178

[56] References Cited

U.S. PATENT DOCUMENTS

| | | | |
|---|---|---|---|
| 1,130,271 | 3/1915 | Hammond | 229/125.26 |
| 1,646,665 | 10/1927 | Smith | 229/125.26 |
| 2,412,402 | 12/1946 | Huye | 229/125.26 |
| 2,559,320 | 7/1951 | Rushing et al. | 229/125.26 |
| 2,652,969 | 9/1953 | Pfaff | 229/125.26 |
| 2,745,589 | 5/1956 | Daly et al. | 229/125.26 |
| 2,809,775 | 10/1957 | White | 229/178 |
| 2,839,236 | 6/1958 | Dunning | 229/145 |
| 3,116,007 | 12/1963 | D'Esposito et al. | 229/125.26 |
| 3,642,193 | 2/1972 | Rada | 229/45 |
| 3,949,931 | 4/1976 | Hall | 229/36 |
| 4,053,100 | 10/1977 | Baptist | 229/125.26 |

FOREIGN PATENT DOCUMENTS

| | | |
|---|---|---|
| 0329496 | 8/1989 | European Pat. Off. . |
| 2419825 | 10/1979 | France . |

*Primary Examiner*—Gary E. Elkins
*Attorney, Agent, or Firm*—Weingarten, Schurgin, Gagnebin & Hayes

[57] ABSTRACT

A packing box with self-locking closure, the packing box comprising a bottom portion including a plane having at least three adjacent sides and a lid portion including a plane having at least three adjacent sides, wherein at least one of the sides of the bottom portion includes a flap provided with a support and further wherein at least one of the sides of the lid portion opposite the bottom portion provided with a flap is provided with a flap holding element which can be combined with a guide in order to ensure that the box is automatically prevented from opening without outside intervention when the lid portion is placed over the bottom portion of the box.

10 Claims, 3 Drawing Sheets

PACKING BOX WITH SELF-LOCKABLE CLOSURE AND PACKING METHOD THEREFOR

FIELD OF THE INVENTION

The present invention relates to a packing box made of cardboard or other packing material and more particularly to a packing box with a self-lockable closure and a packing method therefor.

BACKGROUND OF THE INVENTION

Packing boxes made of cardboard comprising a bottom portion including a rectangular bottom plane and three adjacent sides connected by a connecting strip to a lid portion including a rectangular top plane and three adjacent sides are well known. This type of box is used, in general, by bakers for boxing cakes or by clothing stores for boxing garments. Such boxes may have, on one side thereof, a locking mechanism including a flap associated with a closing element constituting both a handle and a latch for keeping the box closed. In order to use such a box it is necessary to manually close the lid and to subsequently extract the closing element which simultaneously provides both a handle and a locking system for the box. These packing boxes require sequential manual operations which cannot be made to be automatic in order to close and lock the box.

Other packing methods that allow for easy closure are known in the art. Such methods often require a tie, made of either string or ribbon, or some other means for surrounding the package to keep it closed. This tying operation can become burdensome and expensive for packaging a large series of objects.

Thus, a primary object of the present invention is to provide a packing box of simple construction which locks merely upon closing, requiring no tying or other manual manipulation to ensure locking. This object is achieved by providing at least one of the bottom sides of the above-described cardboard packing box having a pair of connected planes with adjacent sides with a flap and also providing a side of the lid portion with flap holding means for receiving the flap. The side of the lid portion opposite the bottom side provided with the flap is further provided with an opening for allowing fingers to pass through to unlock the flap when the box is folded to form a cubic volume. The flap and flap holding means of the present invention ensure that the box is automatically prevented from opening without outside intervention when the lid is snapped into placed over the bottom portion.

SUMMARY OF THE INVENTION

A packing box is provided with a simple and automatic locking system by means of an interactive flap and flap holding combination. In general, but also more particularly when the packing box is made of thin cardboard or any thin material, it is preferable to further provide a guide means for the flap, permitting precise closing as well as secure locking. Indeed, without a guiding means, the flap might be permitted to pass through the flap holding means in such a way that locking would be poorly ensured. The present invention also effectively overcomes this type of disadvantage by providing a packing box wherein the flap is systematically guided into an insured locking position regardless of the thickness or type of cardboard used.

The self-locking packing box of the present invention is characterized by a flap, cut to match a flap holding means wherein the flap is provided with integral support means cooperating with guide means for guiding the flap into the flap holding means. When the lid of the box is placed in a closed position, the support means of the flap slides along the guide means until the flap is locked into place by the flap holding means. After the flap has been locked into place, the support means remain in place against the lateral sides of the flap holding means, providing further structural support to the flap. The flap is caused to be guided laterally when the lid portion is positioned over the bottom portion, such that the flap is prevented from rotating until it snaps into place, providing a secure and effective locking mechanism for the box.

According to one essential characteristic of the invention, the base of the flap adjacent to the side is wider than the width of the opening of the flap holding means, providing support means for the flap by supporting the flap on either side thereof along the lateral walls of the flap holding means. The lateral walls also provide guide means for guiding the flap into the holding means.

According to one preferred, but non-limitative application of the present invention, the flap, connected to the box along a folding line, is configured essentially in the shape of a "T" defined by the intersection of the surfaces of a first rectangular sector adjacent to the folding line and a second adjoining rectangular sector defined by a smaller surface area than that of the first rectangle, wherein the second adjoing rectangular sector is symmetrically narrowed along both sides thereof. In this manner, the first rectangular sector of the flap slides along the guide means, coming to rest thereon after locking is achieved. The description of the flap as an essentially T-shaped configuration must be construed very broadly, as the transition between the narrowed and non-narrowed parts of the flap may be sharp such that there is a discontinuity in the flap to yield a strict "T" shape, or may be gradual such that the flap has, for example, the shape of an isosceles trapezoid.

Locking is accomplished by a slight rotational movement in the flap along the folding line when the lower end of the narrowed part of the flap is released into the flap holding means by reaching the horizontal opening thereof. This slight rotational movement ensures that the lower end of the flap moves into, and remains in contact with, a depression, albeit slight, formed by the horizontal opening of the flap holding means. According to various embodiments of the present invention, the packing box may have several locking devices disposed respectively on each of the sides thereof.

Another purpose of the present invention is to prevent the box from being inadvertently opened after self-locking. This goal is achieved by providing a means for allowing fingers or other objects to push the flap out of the locked position, being composed of a scored orifice which must be broken in order to allow the lid to open.

Yet another goal of the invention is to offer a fully automated packing method for products with automation being facilitated by machine-operated lateral guidance of the flaps to insure secure locking thereof. This goal is achieved through an automated packing process utilizing a cushion made of plastic or another shock absorbing material, cut to a desired size in order to fully surround the product wherein the cross-section of the cushion includes flap holding parts perpendicular to the length of the cushion. The cushion can also include openings along its face, constituting pivoting means to facilitate folding thereof.

Packaging is accomplished by placing a product to be packaged above a reception region on a cushion of given length, the reception region being located directly above the packing box according to the present invention such that in the packing box can receive the product placed within the cushion, the cushion/product assembly thus inserted into the packing box. The cushion automatically deforms as it is introduced into the packing box so that the sides of the cushion completely surround the sides of the product and the top most side of the cushion is folded over the product. Finally, the lid portion of the packing box is folded over the bottom portion and the flaps lock into place in the flap holding means.

DESCRIPTION OF THE DRAWINGS

Other characteristics and advantages of the present invention will become clear from reading the description hereinbelow with reference to the attached drawings, wherein.

DETAILED DESCRIPTION OF THE INVENTION

Figure 3:
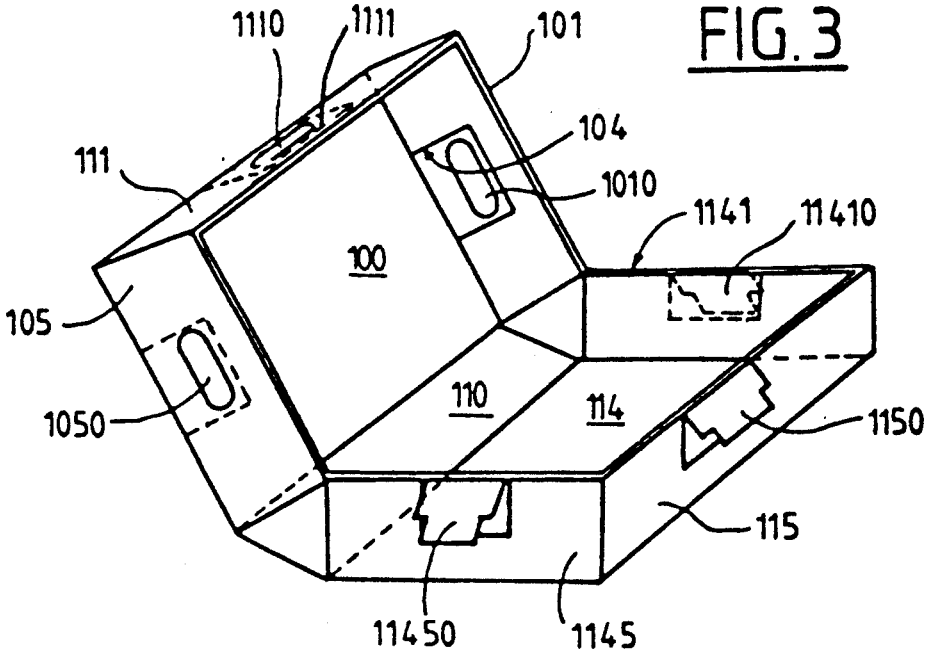
FIG. 3 is a perspective view of the box of the present invention.

The packing box of the present invention is shown in FIG. 3, comprising a bottom portion including a bottom plane (114) having three adjacent sides (1145, 1141, and 115) forming the outer and front sides of the bottom portion of the box. This bottom plane (114) is connected by a connecting side (110) to a lid portion including a top plane (100) having three adjacent sides (101, 105, and 111) forming the outer and front sides of the lid portion of the box. To form the packing box, the lid portion is folded over the bottom portion such that the bottom and lid portions, together with the connecting side, define the periphery of the box.

In one embodiment of the invention, as shown in FIG. 3, the bottom portion of the box is provided with a flap (1150) on the front side (115) cooperating with a matching flap holding means (1110) formed in the front side (111) of the lid portion of the box providing a closing system therefor. In another embodiment, the box may have two side flaps (11450 and 11410) disposed one on each lateral side (1145, 1141) of the bottom portion such that each flap is positioned opposite lateral flap holding means (104, 108) formed in the corresponding lateral sides (101, 105) of the lid portion. Finally, in another embodiment, the box closing system may be composed of three flaps, each positioned on each side of the bottom portion of the box, each flap being associated with corresponding flap holding means in the lid portion of the box.

Figure 1:
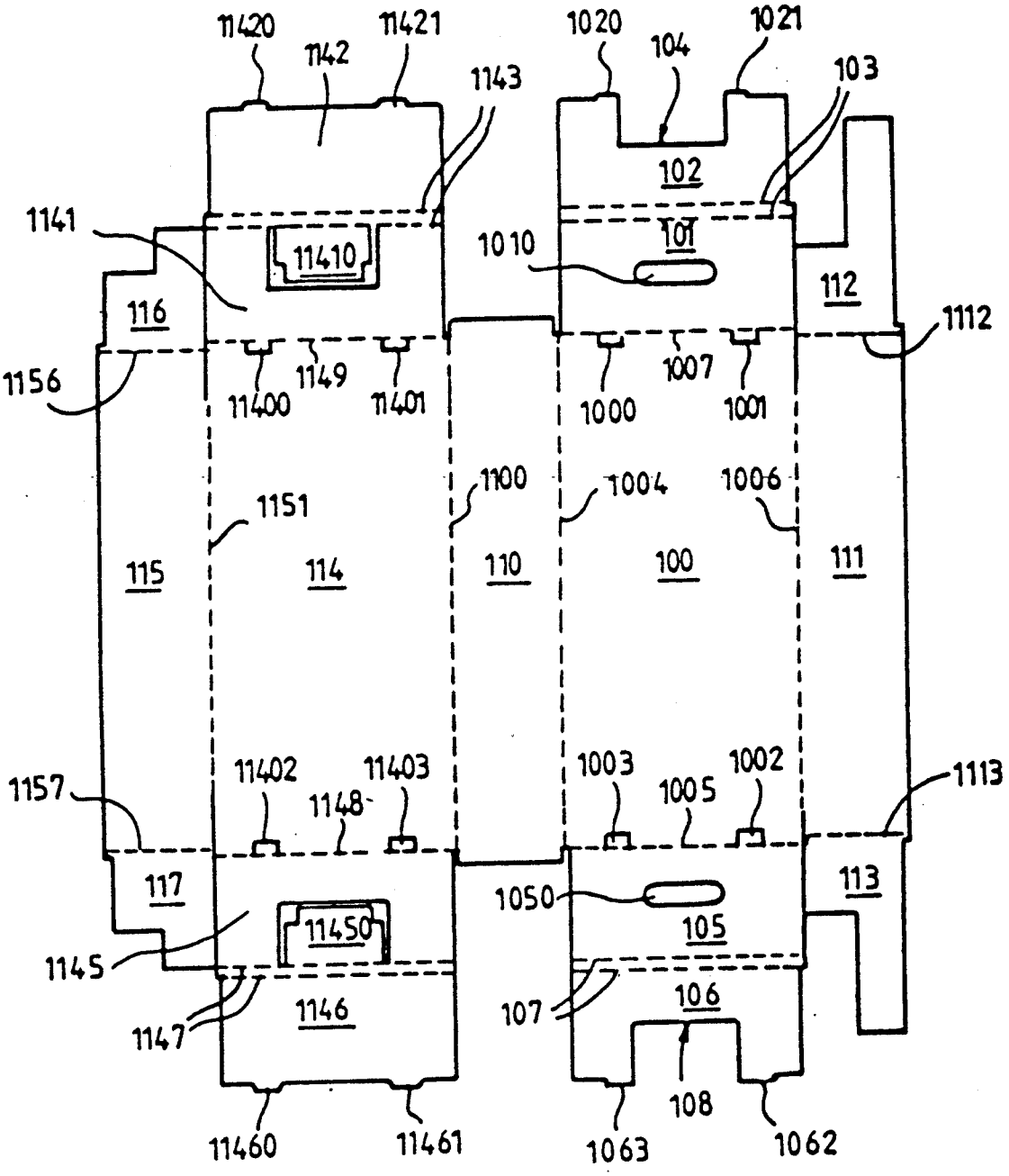
FIG. 1 shows a top view of the cardboard strip which, after folding, constitutes the packing box of the present invention.

The box shown in FIG. 3 is formed from a strip of cardboard, cut as shown in FIG. 1, having reference numerals corresponding to those of FIG. 3. The cardboard strip comprises a first plane (100) constituting the top of the lid portion, delimited by folding lines (1004, 1005, 1006 1007). Folding line (1006) links the first plane (100) to a strip (111) which constitutes the front of the lid portion. Two lateral projections (112, 113) extend from the front side (111) of the lid portion at folding lines (1112, 1113) respectively. Folding line (1004) links the first plane (100) to a strip (110) constituting the connecting side, joining the lid portion to the bottom portion of the box. This connecting strip (110) corresponds to the width, length and height of the box.

Folding line (1007) joins right lateral side (101) to plane (100). This right lateral side (101) is further divided by two folding lines (103), parallel to folding line (1007), forming a peripheral strip (102) such that peripheral side (102) is folded over side (101), peripheral side (102) forms the exterior side of the box while side (101) forms the interior side of the box. Peripheral strip (102) is provided with a notch (104) opening outward and having dimensions greater than the dimensions of the narrow part of associated flap (11410) which will be described later. Peripheral strip (102) further includes a pair of tabs (1020) and (1021), adjacent to the two opposite sides of notch (104), and having dimensions corresponding to indentations (1000, 1001) in folding line (1007). Finally, strip (101), which constitutes the right exterior side of the box is provided with a hole (1010) in the shape of a rounded rectangle whose function, as will be seen later, is to allow passage of a person's fingers or any other projecting apparatus in order to unlock the box. The left side of the box is constructed similar to the above described right side wherein strip (105), folding lines (107) and peripheral strip (106) make up the box side, and peripheral strip (106) includes a notch (108) having adjacent tabs (1062, 1063) for insertion into corresponding indentations (1002, 1003).

Figure 2A:
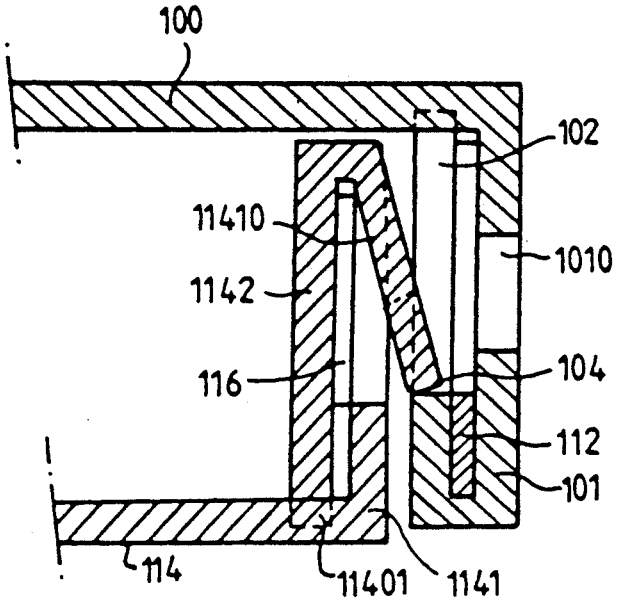
FIG. 2*a* is a partial cross-sectional view of one of the sides of the box of the present invention and the locking system thereof.

In order to form the box as shown in FIG. 3 from the cardboard strip of FIG. 1, peripheral strips (102, 106) are folded inward along folding lines (103, 107) respectively. As previously described, strips (102, 106) form the interior sides of the box and strips (101, 105) form the exterior sides of the box. Projections (112, 113) are folded between interior sides (102, 106) and exterior sides (101, 105) and front side (111) is folded along line (1006). As can be seen in FIG. 2*a*, the outer edges of projections (112, 113), perpendicular to folding lines (1112, 1113), are positioned between folding lines (103, 107). Tabs (1020, 1021, 1062, 1063) are inserted into indentations (1000, 1001, 1002, 1003), respectively, in order to hold the assembly together.

The bottom portion of the box is formed by connecting side (110) joined to second plane (114) via folding line (1100). Plane (114) is delimited by a second folding line (1151) parallel to line (1100) and adjacent to front side (115). Extending from both sides of front side (115) are projections (117, 118) joined to front (115) by folding lines (1157, 1156), respectively.

Strips (1141, 1142) extend from plane (114) at folding line (1149), making up one exterior and interior side, respectively, joined by folding lines (1143). Strips (1145, 1146) extend from plane (114) at folding line (1148), making up another exterior and interior side, respectively, connected together by folding lines (1147). Outer sides (1141, 1145) are provided with flaps (11410, 11450), respectively, connected to the box at folding lines (1143, 1146) respectively. Interior sides (1142, 1146) include end tabs (11420, 11421) and (11460, 11461), respectively, for engagement with indentations (11400, 11401) and (11402, 11403) formed along folding lines (1149, 1148), respectively.

As can be seen in FIG. 2*a*, when the box is folded to form a cubic volume, outer sides (1141, 1145) are folded to be perpendicular to the bottom plane (114), and interior sides (1142, 1146) are folded so that tabs (11420, 11421, 11460, 11461) engage with their respective openings (11400, 11401, 11402, 11403). Projections (116, 117) are simultaneously folded between exterior sides (1141, 1145) and inner sides (1142, 1146), respectively, when side (115) is positioned perpendicular to bottom plane (114) by folding along line (1151). In this manner, flaps (11410, 11450) are formed in exterior sides (1141, 1145), each providing elastic elements extending outward for snapping into flap holding means made up of the horizontal openings (104, 108) in interior sides (102, 106). Thus, by simply closing the lid over the bottom of the box, the flaps (11410, 11450) snap into the horizontal opening provided by notch (104), resulting in a locking connection therebetween.

Figure 2B:
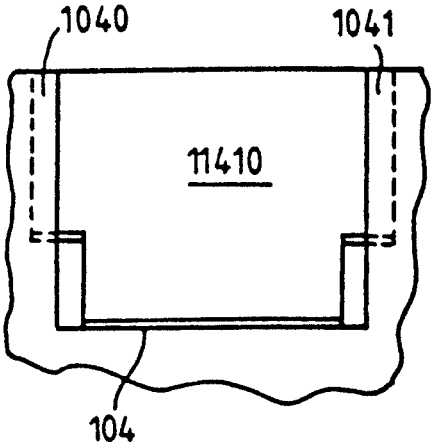
FIG. 2*b* is an exploded view of the locking system of the present invention.

FIG. 2*b* is an exploded view of the locking system of the present invention. The locked position is obtained by sliding part of the flap (11410) along opposite lateral sides (1040, 1041) of flap holding means (104), providing guide means for the locking mechanism of the present invention. In this manner, the lower end of flap (11410) is urged into the horizontal opening of flap holding means (104) while the upper part of the flap (11410) rests against lateral sides (1040, 1041) of notch (104). The lower end of flap (11410) pushes against the thickness of the horizontal opening created by notch (104) to provide the flap holding means.

To open the box, the user slides fingers or any appropriate object into hole (1010), pushing flap (11410) against inner surface (1142). The box can be provided with as many openings and snapping flap systems as desired. Further, in order to prevent the openings from being used to grip the box, which may result in pressure being applied to the flap and the box inadvertently being opened, holes (1010, 1050) can be eliminated and replaced by scored areas that must be broken before the box can be opened. In another embodiment of the present invention, projections (112, 113) can be made to be integral with the inside of inner side (102) or (106) such that the projections have shapes matching holding means (104, 108) and can contribute to the locking mechanism of the present invention.

Figure 4:
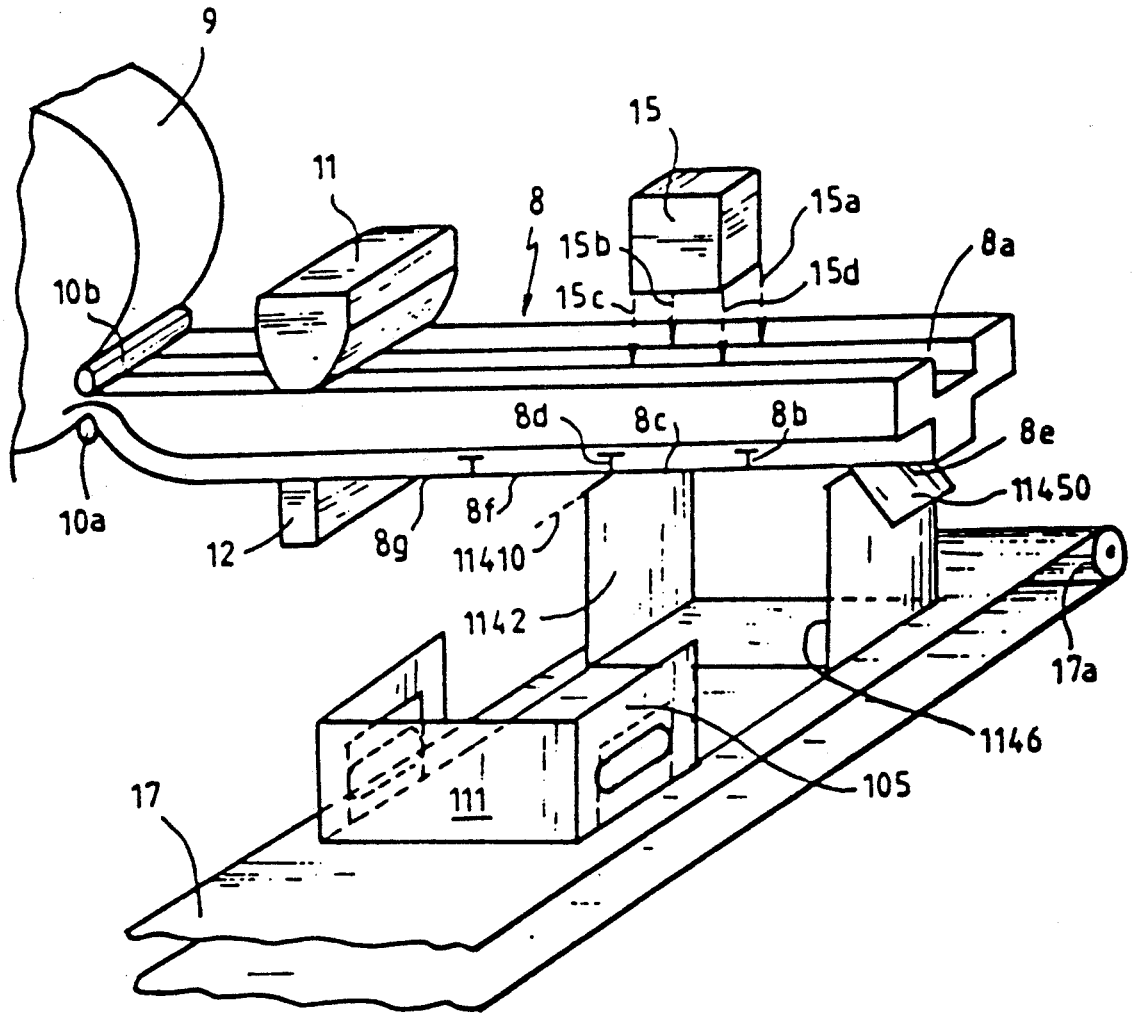
FIG. 4 shows the packing process of the present invention.

FIG. 4 represents a packing process in which the box of the present invention can be used advantageously with a type of cushion which was the subject of French Patent Application No. 88.00879 filed by Bull S.A., entitled "Packing Cushion, Container for Such a Cushion, and Packing Process Employing Such a Cushion." The packing process of the present invention utilizes a shock absorbing cushion in a continuous form, cut to the desired dimension for surrounding a product to be packaged. The cross section of the cushion has holding means defined by a channel (8*a*) perpendicular to the plane of the cushion length and is further provided with a plurality of parallel slits (8*b*, 8*d*) constituting pivoting means to facilitate folding thereof. This packaging cushion can be supplied by a supply roll (9), wherein the cushion is cut to length by a cutter (11, 12).

Once the cushion has been brought above a predetermined area in which the packing box has been positioned, the product to be packaged is placed on the cushion and the cushion is then inserted into the packing box. Cutting lines (8*b*, 8*d*) define the dimensions of the cushion and allow sides (8*f*, 8*e*) of the cushion to fold and slide along the interior sides (1146, 1142) of the box. Product (15) and cushion (8) are placed into the package by gravity and a manipulating arm subsequently folds side (8*g*) onto the product in order to protect the top thereof. A second manipulating arm positions lid portion (100) over the bottom portion (114), simultaneously causing flaps (11410, 11450) to snap into their respective notches (104, 108), thereby allowing side (8*g*) of the cushion to be pressed into position on top of product (15) by lid portion (100).

Other modifications within the understanding of the individual skilled in the art are also part of the spirit of the invention. In particular, the bottom and lid portions of the box may be independent. In this case, the fourth side of the lid portion will be symmetrical with respect to the folding line (1004) of side (111) and connecting side (110) will be replaced by projections symmetrical to projections (112, 113). Likewise, the fourth side of the bottom portion of the box may be symmetrical with respect to folding line (1100) of side (115) having flaps symmetrical to flaps (116, 117) replacing common side (110) since the bottom and lid portions will no longer be connected by a common side (110). Accordingly, it is understood that the disclosed invention is not to be limited by what has been particularly shown and described except as indicated by the present claims which follow.

We claim:

1. A packing box having a self-locking closure comprising:

a bottom portion including a first plane and at least three adjacent sides for forming an open cubic volume, open at least at the top thereof;

a lid portion including a second plane and at least three adjacent sides for forming an open cubic volume open at least at the bottom thereof; wherein at least one of the sides of said bottom portion includes a flap connected to said bottom portion by a folded edge such that said flap pivots along said folded edge; and at least one of the sides of said lid portion opposite the side of said bottom portion provided with the flap includes flap holding means for receiving said flap to ensure that when said lid portion is placed over said bottom portion, said lid portion snaps into position, preventing said packing box from opening without outside intervention;

said at least one side further including a scored orifice which must be broken to allow access to said flap holding means when said lid portion is mated to said bottom portion to comprise said packing box.

2. A packing box having a self-locking closure according to claim 1, wherein:

said flap further includes support means; and said flap holding means further includes guide means;

said support means being cooperative with said guide means so that said support means slides along said guide means until said flap is positioned in said flap holding means, said support means coming to rest against said guide means.

3. A packing box according to claim 2, wherein:

said flap has a dimension along said folding edge that is greater than the width of said holding means wherein the greater width is guided on either side of said guide means to slide along lateral walls of said flap holding.

4. A packing box according to claim 3, wherein:

said flap is essentially in the shape of a T, having a surface defined by an intersection of a first rectangular sector adjacent to said folded edge, delimited by a first opening, and an adjoining second rectangular sector having a smaller width than that of said first rectangular sector, said second rectangular sector being delimited by a second opening; wherein said adjoining rectangular sector is located opposite said folded edge and is symmetrically narrowed on both sides thereof.

5. A packing box according to claim 1, further including a connecting side wherein:

said bottom portion having three sides is connected to said lid portion having three adjacent sides by said connecting side.

6. A packing box according to claim 1, wherein:

at least two sides of said bottom portion each include a flap, each said flap being connected to said bottom portion along a folded edge such that said flap pivots along said folded edge; and corresponding sides of said lid portion each include flap holding means for receiving said flap to prevent the box from opening without outside intervention, each said corresponding sides further including a scored orifice which must be broken to allow access to said flap holding means for opening said box when said lid portion is mated to said bottom portion to comprise said packing box.

7. A packing box according to claim 1, wherein:

at least three sides of said bottom portion each include a flap, each said flap being connected to said bottom portion along a folded edge such that said flap pivots along said folded edge; and corresponding sides of said lid portion each include flap holding means for receiving said flap to prevent the box from opening without outside intervention, each said corresponding sides further including said flap holding means for opening said box when said lid portion is mated to said bottom portion to comprise said packing box.

8. A packing box according to claim 1, wherein:

said means for allowing an object to pass therethrough comprises an opening cut out of the respective side of the lid portion.

9. A packing box according to claim 1, wherein:

said orifice is formed in a single cardboard strip having interior and exterior lateral surfaces connected together by a folding line, separating said orifice from said flap holding means.

10. A packing box having a self-locking closure comprising:

a bottom portion including a first plane and at least three adjacent sides for forming an open cubic volume, open at least at the top thereof;

a lid portion including a second plane and at least three adjacent sides for forming an open cubic volume open at least at the bottom thereof;

at least one cardboard strip connected to said bottom portion by a first folded edge such that said cardboard strip pivots along said first folded edge, said cardboard strip having a second folded edge generally parallel to said first folded edge and defining a first portion and a second portion, said first portion being located between said folded edges, said cardboard strip further having a flap cut out of said first portion such that said flap pivots along said second folded edge; and at least one of the sides of said lid portion opposite the side of said bottom portion provided with said cardboard strip having said flap includes flap holding means for receiving said flap to ensure that when said lid portion is placed over said bottom portion, said lid portion snaps into position, preventing said packing box from opening without outside intervention;

said at least one side further including means for providing access to said flap holding means when said lid portion is mated to said bottom portion to comprise said packing box.

* * * * *

UNITED STATES PATENT AND TRADEMARK OFFICE

CERTIFICATE OF CORRECTION

PATENT NO. : 5,040,722

DATED : August 20, 1991

INVENTOR(S) : Andre Fromion, et. al.

It is certified that error appears in the above-identified patent and that said Letters Patent is hereby corrected as shown below:

On the Title page, item [75], after Inventors: "les" should read --Les--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*